United States Patent [19]

Rohner et al.

[11] 4,344,277

[45] Aug. 17, 1982

[54] METHOD AND APPARATUS FOR CONNECTING AN UPPER THREAD WITH A LOWER THREAD

[75] Inventors: Joachim Rohner; Heinz Zumfeld; Reinhard Mauries, all of Mönchengladbach, Fed. Rep. of Germany

[73] Assignee: W. Schlafhorst & Co., Mönchengladbach, Fed. Rep. of Germany

[21] Appl. No.: 155,219

[22] Filed: Jun. 2, 1980

[30] Foreign Application Priority Data

Jun. 2, 1979 [DE] Fed. Rep. of Germany ..... 2922694

[51] Int. Cl.[3] ..... D01H 15/00

[52] U.S. Cl. ..... 57/22

[58] Field of Search ..... 57/22, 23, 261; 242/35.5 R, 35.6 R

[56] References Cited

U.S. PATENT DOCUMENTS

| | | | |
|---|---|---|---|
| 4,002,012 | 1/1977 | Norris et al. | 57/22 |
| 4,217,749 | 8/1980 | Rohner et al. | 57/22 X |
| 4,232,509 | 11/1980 | Rohner et al. | 57/261 |
| 4,246,744 | 1/1981 | Matsui et al. | 57/261 X |

*Primary Examiner*—Donald Watkins

*Attorney, Agent, or Firm*—Herbert L. Lerner; Laurence A. Greenberg

[57] ABSTRACT

Method for connecting an upper thread to a lower thread, which includes inserting the threads into a longitudinal groove formed in a chamber for connecting the threads with a thread feeder being movable from a thread receiving position to a thread delivery position, splicing the threads together in the chamber using compressed air acting on the threads from the side, securely holding the threads up to the application of the compressed air when the threads are inserted into the chamber uncrossed, and securely holding the threads which are inserted into the chamber during the splicing in the immediate vicinity of the chamber when the threads are crossed during movement of the thread feeder, and a device for carrying out the method.

25 Claims, 3 Drawing Figures

METHOD AND APPARATUS FOR CONNECTING AN UPPER THREAD WITH A LOWER THREAD

The invention relates to a method and apparatus for connecting an upper thread with a lower thread by means of a device comprising a chamber in which the threads are inserted and connected, wherein the threads are spliced with each other by compressed air acting from the side upon them, and the threads are connected with each other in this manner.

Up to now the threads have been inserted by hand in a device of this type. Therefore, the quality of the thread joint, as well as the time required to produce the connection, were left to chance. It is accordingly an object of the invention to provide a method and device for connecting an upper thread to a lower thread, which overcomes the hereinafore-mentioned disadvantages of the heretofore-known methods and devices of this general type, and to eliminate all quality reducing factors and influences depending on manual dexterity during the production of splice-connections, and also to make it possible to splice thin and even very thin threads.

With the foregoing and other objects in view there is provided, in accordance with the invention, a method for connecting an upper thread to a lower thread, which comprises inserting the threads into a longitudinal groove formed in a chamber for connecting the threads with a thread feeder being movable from a thread receiving position to a thread delivery position, splicing the threads together in the chamber using compressed air acting on the threads from the side, securely holding the threads up to the application of the compressed air when the threads are inserted into the chamber uncrossed, and securely holding the threads which are inserted into the chamber during the splicing in the immediate vicinity of the chamber when the threads are crossed during movement of the thread feeder.

In accordance with another mode of the invention, there is provided a method which includes elastically pressing the threads against the outer surface of the chamber and wrapping the threads around rims of the groove formed in the chamber at an angle of approximately 90°.

In accordance with a further mode of the invention, there is provided a method which includes pressing the threads with two holders or pressing the threads with the thread feeder or pressing the threads with separate pressing means.

In accordance with an added mode of the invention, there is provided a method which includes closing the chamber with a cover, automatically severing the ends of the upper and lower threads, and blowing compressed air into the chamber, in dependence on the position of the thread feeder or holders.

In accordance with an additional mode of the invention, there is provided a method which includes locating and securing the end of each of the upper and lower thread with a hingeable thread feeder, and sequentially laying the threads parallel, overlapping or crossed by swinging motion of the two swingable thread feeders.

In accordance with the device of the invention, there is provided an apparatus for carrying out a method for connecting an upper thread to a lower thread comprising a chamber for inserting and connecting the threads, a channel having an end disposed within the chamber for supplying compressed air, and two holders pivotable from a starting position to a thread holding position in the immediate vicinity of the chamber.

In accordance with another feature of the invention, the chamber has an upper and a lower surface and a groove formed therein with discharge rims at the ends of the groove, and there is provided a flexible bracket being integral with each of the holders and respectively disposed immediately above and below the rims, the brackets being swingable above and below the surfaces of the chamber.

In accordance with a further feature of the invention, the holders are connected to each other, and there is provided a common drive for the holders.

In accordance with an added feature of the invention, there is provided at least one thread feeder movable from a thread receiving position to a thread delivery position for inserting the threads into the longitudinal groove formed in the chamber, and there is further provided a cover for temporarily closing the chamber, a device for cutting off the ends of the upper and lower threads, and a regulating valve for adjustably controlling the compressed air, the cover, cutting device and valve being controllable in dependence on the position of at least one of the thread feeder and holders.

In accordacne with an additional feature of the invention, the thread feeder is hingeably supported, and there are provided two arms integral with the thread feeder for guiding the threads, the arms being swingable in planes lying respectively above and below the chamber.

In accordance with still another feature of the invention, there is provided a device for receiving and conducting the upper thread, a first clamping device disposed below the chamber, a second clamping device disposed above the chamber, a first pivotably supported thread feeder having a device for locating and securing the end of the upper thread and being swingable from the receiving and conducting device to the first clamping device, and a second pivotably supported thread feeder having a device for locating and securing the end of the lower thread and being swingable from a point in the path of the lower thread to the second clamping device.

In accordance with still a further feature of the invention, there is provided a device for controlling the clamping devices in dependence on the position of one of the first-mentioned thread feeder and the pivotably supported thread feeders.

In accordance with still an added feature of the invention, the arms have thread receiving slots formed therein, the slots being respectively positioned obliquely above and behind and below and behind the rims in the thread delivery position of the thread feeder, whereby the threads wrap around the rims.

In accordance with still an additional feature of the invention, there is provided a controllable thread cutting device disposed on each of the arms.

In accordance with yet another feature of the invention, there is provided a controllable adjustable compressed air regulating valve connected in the compressed air channel, especially for setting the blowing intervals.

In accordance with yet a further feature of the invention, there is provided a proximity switch for controlling the regulating valve in response to the movement of the thread feeder and/or there is provided a device for setting and controlling air pressure being connected in the compressed air channel, and a proximity switch for controlling the air pressure setting and controlling device in response to the movement of the thread feeder; the proximity switch may be fixed or adjustable.

In accordance with yet an added feature of the invention, there is provided a settable and controllable timing switch device connected to the regulating valve and/or to the air pressure setting and controlling device.

In accordance with yet an additional feature of the invention, there is provided a central setting device connected to the regulating valve and/or to the air pressure setting and controlling device and/or to the timing switch device at a plurality of work stations.

In accordance with a concomitant feature of the invention, there is provided a compressed air accumulator connected to the air input side of the regulating valve.

The advantages achieved by the invention are, especially, the facts that the strength, quality, and appearance of the splice connection is improved to such an extent that thin threads can also be spliced with success. Beyond this, the invention teaches a way of automating the complete operation of connecting threads in an advantageous manner, from starting of locating the threads at the device which delivers the lower thread and at the device which receives the upper thread or conducts if further on. The invention also has the capability of ensuring that the very reliably joined threads are pulled out of the chamber and removed from the device for connecting the threads by the newly applied winding-pull and the thereby-applied transverse force on the thread-strand. All operational steps are coordinated with each other as the timing and the duration of each essential operational step is adjustable. This applies especially for the moment and duration of blowing in air or admitting air, and for the timing of the cut-off operation of the excessive thread ends. The device for connecting the upper thread with the lower thread can be a travelling device which moves from working station to working station.

If the thread-feeder works with air suction, it is advantageous to attach a controllable clamping cover to the suction nozzle which clears the suction nozzle only as long as the thread is searched for and received. The later holding of the thread end is taken over thereafter by the clamping cover, which at the same time closes the suction nozzle.

For the insertion of the threads that are to be connected into the longitudinal slot, a single, preferably two-armed, hingeable thread-feeder is sufficient in some cases. If the threads must still be located in the delivery or receiving regions, at least two hingeable thread-feeders are required. It proved to be especially advantageous to provide still a third thread-feeder, which accepts the threads from the first-mentioned thread-feeders, and transports it into the chamber by swinging sideways. In this way the threads are crossed at the same time in some cases. The chamber can be constructed open, or so that it can be closed.

Other features which are considered as characteristic for the invention are set forth in the appended claims.

Although the invention is illustrated and described herein as embodied in a method and apparatus for connecting an upper thread with a lower thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 3:
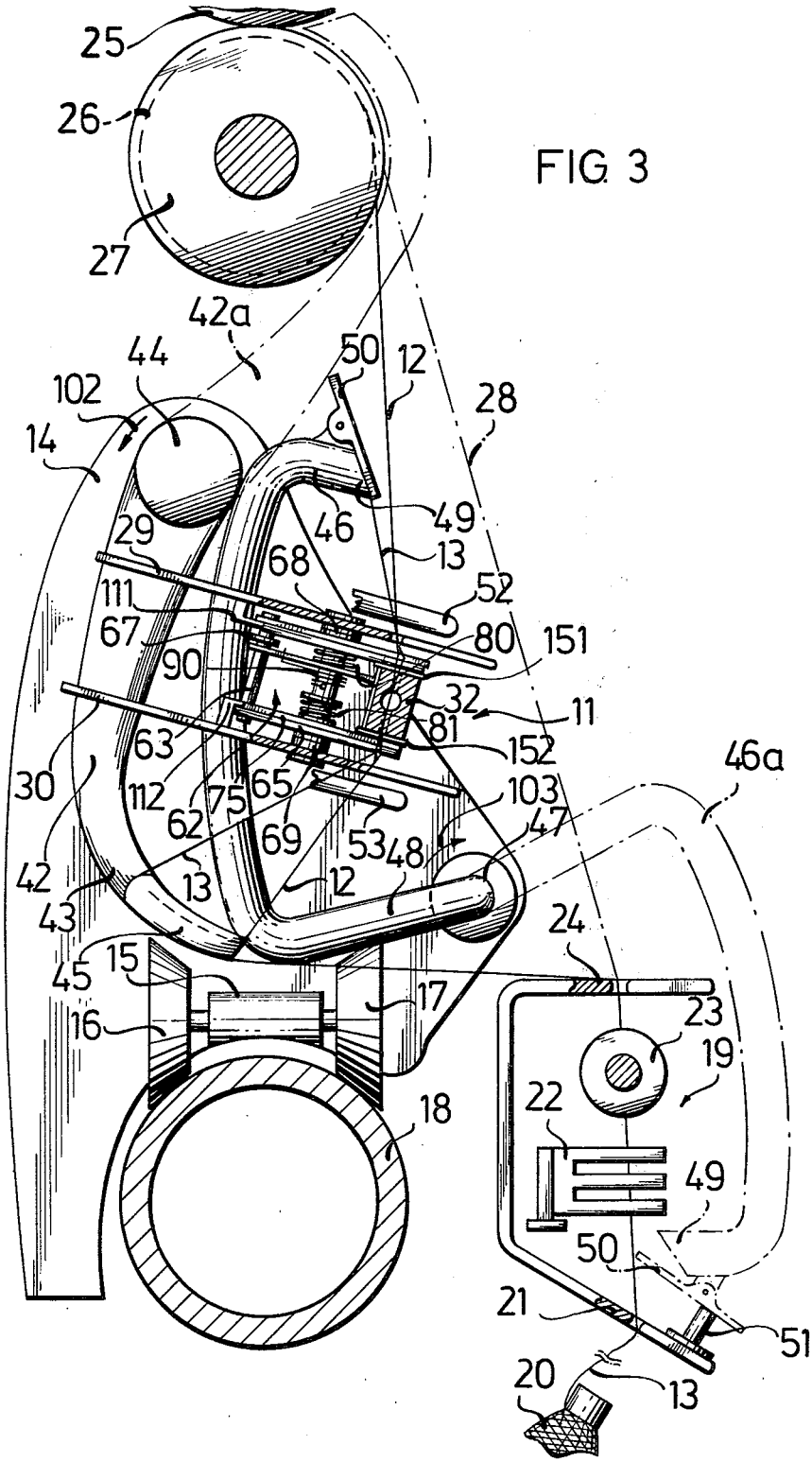
FIG. 3 is a side elevational view of the device.

Referring now to the figures of the drawing as a whole, there is seen a device for connecting an upper thread 12 to a lower thread 13, the device as a whole being designated with reference numeral 11. The device has a machine frame 14, which carries a carriage 15, as shown in FIG. 3. The carriage 15 is provided with carriage-rollers 16 and 17. With the aid of the rollers 16, 17 the device 11 is movable on a carrier-tube 18.

The carrier-tube 18 runs along a winding machine, only one winding station 19 of which is shown according to FIG. 3. The device 11 is shown in operation at this winding station 19. It can be seen from FIG. 3 that at the winding station 19, the lower thread 13 runs to the device 11 from a run-off coil 20 over a thread guide 21, a comb-feeder 22, a thread brake 23 and another thread guide 24. The upper thread 12 also is conducted to the device 11 from a take-up coil 25, over a rotating threadguide drum 27 which is provided with reverse thread grooves 26.

In the narrower sense, the device providing the lower thread 13 comprises the thread guide 21; and the device receiving the upper thread comprises the take-up coil 25. The line of the shortest possible uninfluenced and undisturbed path of the thread is designated by reference numeral 28. In FIG. 3, the line 28 is a dot-dash line, indicating that the path of the thread is already disturbed, and that the thread is divided into an upper thread and a lower thread.

Figure 1:
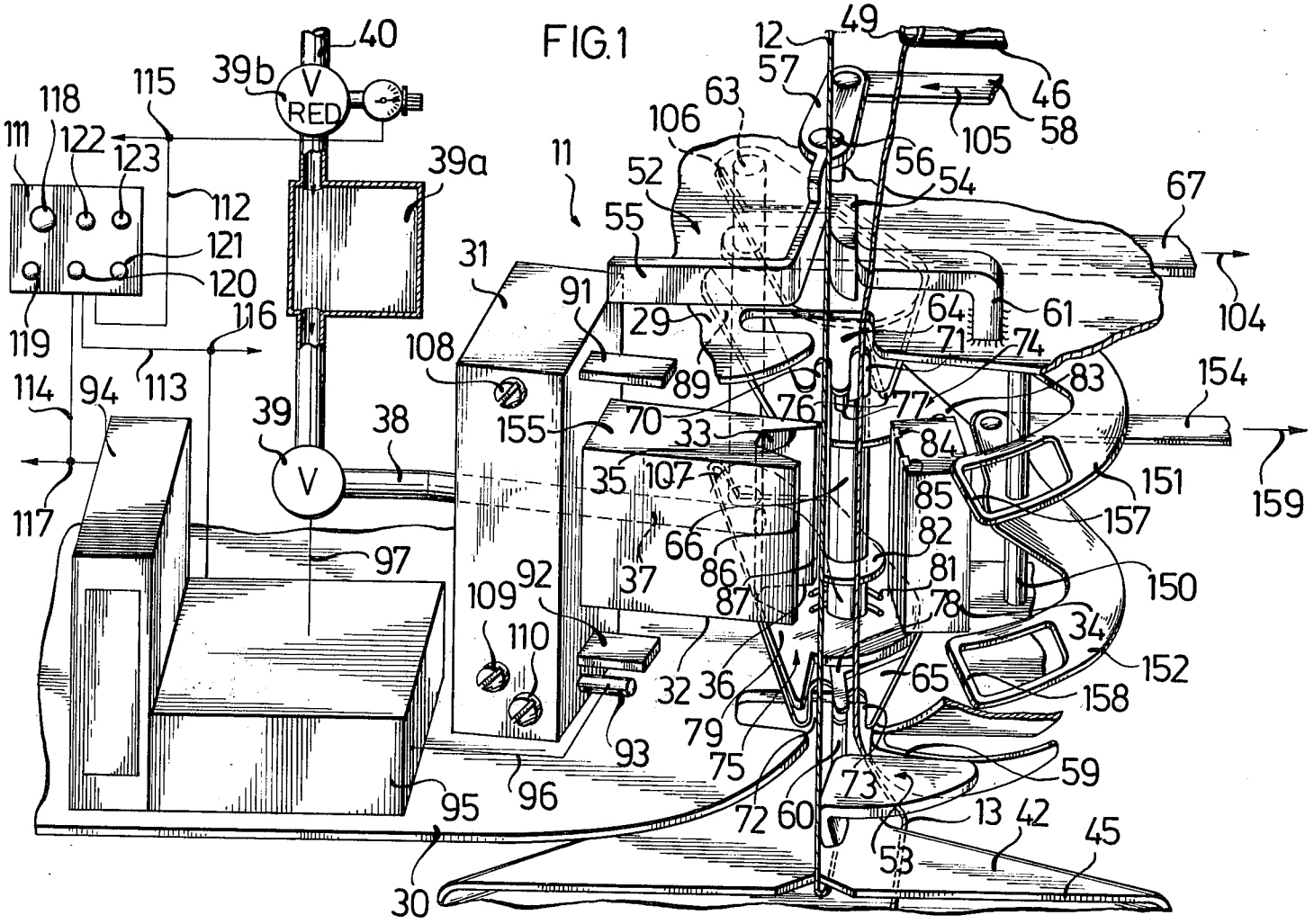
FIG. 1 is a diagrammatic, fragmentary, perspective view of the device accordance to the invention with the chamber open.
Figure 2:
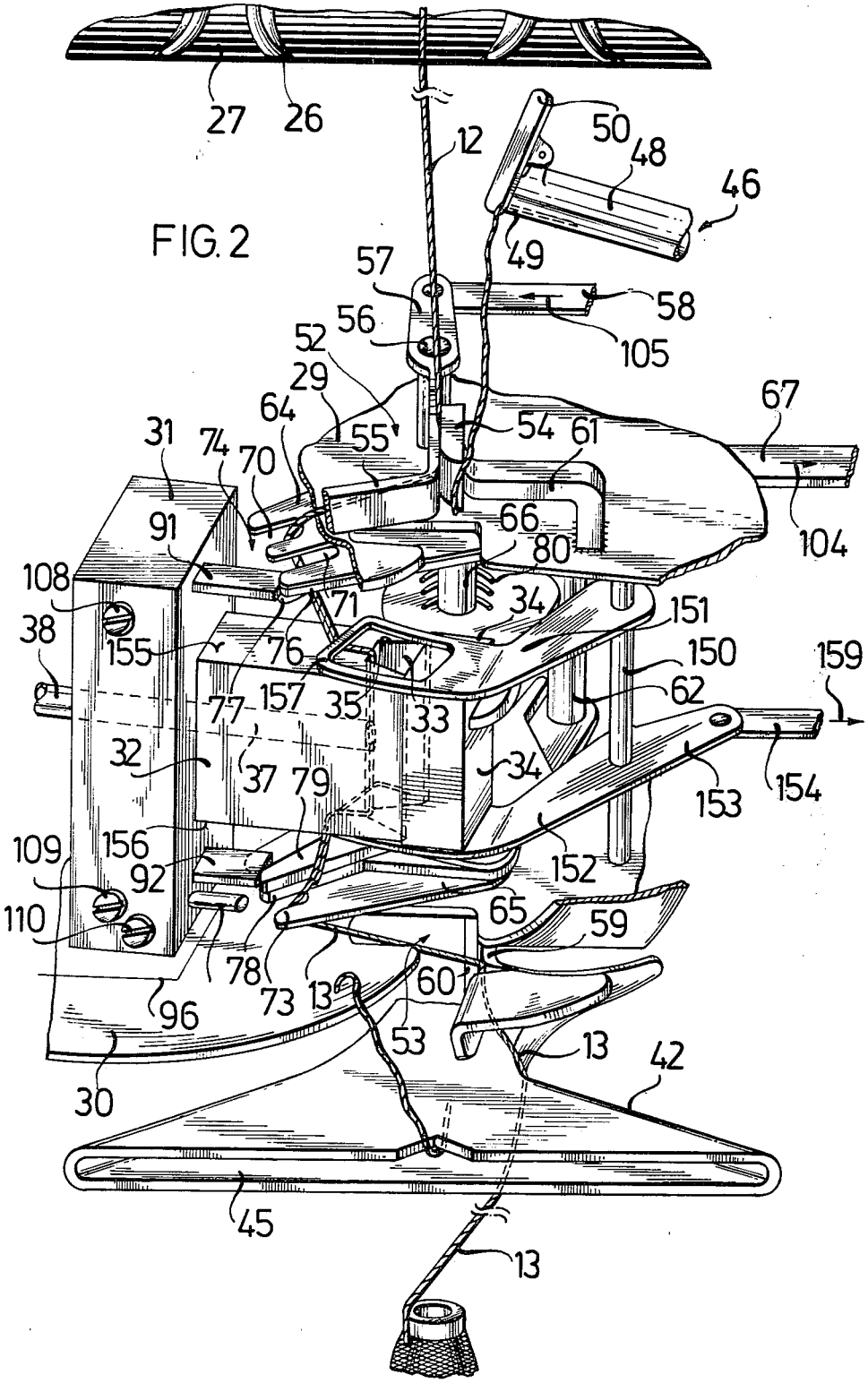
FIG. 2 is a view similar to FIG. 1 with the chamber closed.

The device 11 is provided with two plates 29, 30 which are connected with each other by a carrier 31 as seen in FIGS. 1 and 2. A chamber 32 is fastened to the carrier 31. The chamber 32 has a longitudinal groove 33 which can be closed by a cover 34. When the cover is opened, the threads can be layed into the longitudinal groove of the chamber. The end edges 35, 36 of the longitudinal groove 33 are rounded. A channel 37 for compressed air discharges into the inner space of the chamber 32. The inner space is formed by the longitudinal groove 33 and the cover 34. The channel 37 for the compressed air continues in a tube 38. At the intake side of an air-pressure regulating valve 39, there is provided an accumulator **39*a* for compressed air. An adjustable pressure reducer 39*b* is disposed upstream of the accumulator 39*a*. The air-pressure regulating valve 39 can be connected to a source of compressed air by a pipeline 40**.

As best seen in FIG. 3, a thread feeder 42 is provided with means for locating and holding the end of the upper thread 12 on the takeup coil 25. These means comprise an arm 43 which is hollow inside and is connected by a pivotable joint 44 to a source of negative pressure; these means also comprise a suction nozzle 45 having a slot formed therein. The drawing of FIG. 3 shows the thread feeder 42 in the thread delivery-position. The thread-accepting position is designated by reference numeral **42*a*, and is shown in dot-dash lines in FIG. 3**.

Another hingeable thread feeder 46 seen in FIG. 3 is provided with means for finding and holding the end of the lower thread 13. These means comprise a curved tube 48, which is rotatable in the pivot joint 47 and is provided with a suction nozzle 49 which is closed with a clamping-cover 50 by spring action. The thread feeder 46 is also shown in FIG. 3 in the thread delivery position. Its thread-accepting position is designated by reference numeral 46*a*, and shown in dot-dash lines in FIG. 3. In order to receive the thread end of the lower thread 13, the clamping cover 50 is opened by hitting it against a stop 51. Now the lower thread 13 which is interrupted at a point which is approximately above the thread brake 23, can be sucked in by the suction nozzle 49, and after the thread feeder 46 has swung back to the thread delivery position the thread can be clamped, held, and taken along between the clamping-cover 50 and the rim of the suction nozzle 40.

In the drawings, two controllable thread-clamping devices 52, 53 can also be recognized. The thread-clamping device 52 is above the chamber 32, and also above the plate 29; the thread-clamping device 53 is below the chamber 32, and also below the plate 30. Each of the two thread-clamping devices is constructed of two parts. The thread-clamping device 52 comprises a stationary clamping-member 54, and a controllable clamp 55 which hinges around a pivot joint 56. The clamp 55 is provided with a lever 57 that can be controlled by means of a rod 58 by a non-illustrated cam disc. The thread-clamping device 53 comprises a stationary clamping member 59 and a controllable clamp 60 which, similar to the clamp 55 of the clamping device 52, can be controlled by a cam disc which is not shown. The stationary member 54 is connected to the plate 29 by a bracket 61. The clamping member 59 is connected with the plate 30.

Furthermore, in the drawings there is seen a hingeable, two-armed thread-feeder or thread-bringer 62, comprising a rod 63 to which two arms 64, 65 are fastened. The thread-feeder 62 is hingeably mounted on a shaft 66 which connects the plate 29 to the plate 30. A link 67 is articulatingly connected with the rod 63 for swinging the thread-feeder 62 around the shaft 66.

Spacer discs 68, 69 serve for centering the thread-feeder 62. The thread-feeder 62 can swing from the thread-accepting position shown in FIG. 1, to the thread-delivery position shown in FIG. 2. The plane of swinging motion of the arm 64 lies above the chamber 32, and the plane of motion of the arm 65 lies below chamber 32. In the thread-accepting position after the swinging motion of the thread-feeders 42 and 46, both arms of the thread-feeder 62 lie in the thread-path of the threads 12, 13 which run parallel in their thread-delivery positions.

Each arm of the thread-feeder 62 is provided with two adjacent thread-acceptance slots of different depth. FIG. 1 and FIG. 2 of the drawings show that the thread-acceptance slot 71 of the arm 64 is deeper than the thread-acceptance slot 70. Similarly, the thread-acceptance slot 72 of arm 65 is deeper than the thread-acceptance slot 73. These slots of unequal depth are so disposed that the less deep thread-acceptance slot of one arm is always aligned above the deeper thread-acceptance slot of the other arm. In the thread-acceptance position of the thread-feeder 62, the thread-acceptance slots lie approximately in the plane of motion of the thread-feeders 42 and 46. Each arm of the thread-feeder 62 has a controllable thread-cutting device. The thread cutting device 74 is assigned to the arm 64, and the thread-cutting device 75 is assigned to the arm 65. Each thread-cutting device comprises two knives which work together like scissors. One knife is always connected to the associated arm, and the other knife, always the one nearer to the chamber 32, is hingeably supported about the axis 66. For example, the knife 76 of the thread-cutting device 74 is connected to the arm 64, while the knife 77 of the same thread-cutting device is hingeably supported. The knife 78 of the thread-cutting device 75 is connected to the arm 65, while the knife 79 of the same thread-cutting device is hingeably supported. FIG. 2 shows especially clearly that the knife 77 is pressed by a helical spring 80 against the knife 76. FIG. 1 shows that the knife 79 is also pressed against the knife 78 by a helical spring 81. The helical spring 81 is braced against a disc 82 which is fastened on the shaft 66. The helical spring 80 is braced against the swing-arm 83 which is rotatably supported on the shaft 66, and carries the cover 34 of the chamber 32. The cover 34 has inlays 84, 85 in the form of a sealing material, which lie against the edges of the longitudinal groove 33 when the cover closes, and thereby prevent compressed air and single fibers from escaping sideways from the chamber 32. The thread-feeder 62, the thread-cutting devices 74, 75 and the swingarm 83 of the cover 34 have not only a common pivot axis or shaft 66, but are also pivotable together. For this purpose, the swing-arm 83 carries a lever 89 at its back end which leans against the rod 63 caused by the effect of a wound spiral spring 90 shown in FIG. 3. While the two knives 76 and 78 are connected to the arms 64 and 65, respectively, the hingeable knives 77 and 79 are also taken along by the swinging motion of the thread-feeder 62 by the effect of the helical springs 80, 81. This following of the knives 76 and 78 is limited by adjustable stops 91, 92. Set screws 108 and 109 are provided for this adjustment. This makes it possible to precisely adjust the point in time for cutting-off the thread ends, and to tune it to the timing of the admittance of compressed air, or to the blower time. If the thread-feeder 62 is now swung to the position shown in FIG. 2, the thread-cutting devices 74 and 75 close, whereby the lever 106 of the knife 77, and a similar lever 107 of knife 79, lift off from rod 63. The thread-cutting devices are now closed like scissors. When the thread-feeder 62 is swung back to the thread-acceptance position, the rod 63 leans or lays against the levers 106 and 107 which causes the thread-cutting device to open again like scissors as the swinging motion continues. The thread-cut-off devices 74 and 75 are so disposed that they are always activated at those thread receiving slots in which the thread ends which are to be cut lie, i.e. for the arm 64 at the thread receiving slot 71 and for the arm 65 at the thread receiving slot 72. FIG. 2 shows that the thread receiving slots of the thread-feeder 62, in the illustrated thread-delivery position, are disposed obliquely above and below, behind the discharge rims or end edges 35, 36 of the chamber 32, respectively, so that the threads loop around the discharge rims. A shaft 150 is rotatably supported at the plates 29, 30. Two holders 151 and 152 are fastened to the shaft 150. The holder 152 is provided with an extension 153 at its rear, to which a controllever is articulatingly connected as part of a drive 154 which is not shown.

Each holder 151, 152 is provided with a springy (flexible) bracket 157, 158, respectively, which can swing-in directly above the discharge rims 35, 36 and above the outer surfaces 155, 156 of the chamber 32.

FIG. 1 shows the two holders 151 and 152 in the starting position. In FIG. 2, the thread-holding position is shown. In the thread-holding position, each bracket clamps both threads 12, 13 against the outer surfaces 155 and 156, respectively, of the chamber 32 for as long as is required to complete the splicing operation.

The regulating valve 39 can be controlled by means of a proximity switch 93, which is activated by the motion of the thread-feeder 62. The switch 93 can be adjusted in its position at the carrier 31 by a set screw 110, can be set by a timing switch device 94 and also be controlled by the latter. For this purpose, the parts 39, 93 and 94 are connected to a switch box 95, which comprises electric switching means. The feature of the proximity switch 93 being settable or adjustable assures the precise setting of the beginning air-blower action in dependence on the position of the threadfeeder 62, and thereby also in dependence on the position of the thread cutting devices and the point in time when the thread ends are cut. In FIG. 1 there is seen the line 96 leading to the proximity switch 93 and also the line 97 leading to the air pressure regulating valve 39.

The air pressure regulating valve 39 can be adjusted with respect to the length of the intervals and with respect to their spacing in time or rate of occurrence. Furthermore, the air pressure regulating valve 39 is connected to the pressure reducer **39*b* which serves for setting and controlling the air pressure. For setting a central control, a device 111 is provided to which the pressure reducer 39*b*, the switch-box 95 and the time switch device 94 are connected by the lines 112, 113 and 114, respectively. From the branching points 115, 116, 117 of these lines branches originate which go to the pressure reducers, switch-boxes and timing devices of the other work stations of the textile machine which comprises the hereinafore-described device 11. The central setting of the air pressure is effected by a button 118; the setting of three different blower intervals is set by buttons 119, 120, 121; and the time spacing of the intervals is set by the buttons 122 and 123**.

FIG. 1 and FIG. 2 show that several parts of the device 11 have special contours for guiding the thread. This is the case, for example, with the suction slot nozzle 45, with the thread clamping devices 52, 53 and the plates 29 and 30.

The functioning of the device according to the invention will now be explained with the aid of the drawings, using a thread-connecting operation as an example. The hereinafore-mentioned settings of the control device 111 have already been performed.

First let it be assumed that the thread, previously running along the line 28, is broken at the winding station 19. Therefore an upper thread 12 and a lower thread 13 are created. The upper thread was taken up by the take-up coil 25, the lower thread 13 has been arrested by the thread-brake 23 in connection with the comb-feeder 22.

The thread break is detected in a conventional manner by means which are not shown, and is signalled or communicated to the device 11. According to FIG. 3, the device 11 moves on the carrier tube 18 in front of a winding station 19. The thread-feeders 42 and 46 are in the rest position which is identical with the thread delivery position, if one visualizes that the threads, already shown in FIG. 3, are not there. The third thread-feeder 62 is in the thread receiving position shown in FIG. 1. The threads shown in the drawing should be considered as not existing initially. The device 11 now operates as follows:

In the machine frame 14, a non-illustrated control drive is provided which automatically starts at a signal caused by the winding station 19, and rotates the pivot joint 44 of the thread-feeder 42 in the direction of the arrow 102, until the thread-feeder has reached the thread-receiving position **42*a*. In this position, the suction-slot nozzle 45 is very close to the surface of the take-up coil 25. The suction-slot nozzle extends over the whole width of the take-up coil 25. By the negative pressure existing at the suction-slot nozzle 45, while the take-up coil 25 slowly turns and runs out, respectively, the thread end of the upper thread is located, sucked-up and secured. Simultaneously, the control drive rotates the pivot joint 47 of the thread-feeder 46 in the direction of the arrow 103, until the thread-feeder 46 has reached the thread-receiving position 46*a*. Here, the clamping cover 50 hits the stop 51, and thereby opens. Now the negative pressure at the suction nozzle 49 can suck in the thread end of the lower thread 13** and hold it securely.

After a short action time which is exactly set, the control drive returns the two pivot joints 44 and 47 to the starting positions. Thereby, the two thread-feeders 42 and 46 simultaneously swing to the thread-delivery positions, shown in FIG. 3 with solid lines. During the swing-motion of the thread-feeder 46, the clamping cover 50 closes again, and thereby clamps the thread end.

During the return motion of the thread-feeders 42 and 46, the threads move into the thread receiving slots of the thread-feeder 62. The above-mentioned thread-guide contours make certain that the upper thread coming from the take-up coil 25 is inserted between the clamping-member 54 and the clamp 55 of the thread-clamping device 52 and is layed into the thread receiving slots 70 and 72 of the thread-feeder 62. The lower thread 13, coming over the thread guide 21 from the run-off coil 20, is layed into the comb-feeder 22, the thread brake 23, and the thread guide 24, is then conducted over the rear side of the suction-slot nozzle 45 of the thread-feeder 42 between clamping member 59 and clamp 60 of the thread clamping device 53, and layed into the thread receiving slots 73 and 71 of the thread-feeder 62. Because both thread-feeders 42 and 46 swing back simultaneously, the rounded rear side of the suction slot nozzle 45 takes along the lower thread 13 and directs it outward, as shown in the drawing of FIG. 3. The thread clamping devices 52 and 53 are open during the swing-motion of the thread-feeders 42 and 46.

Now the control drive sets three non-illustrated cam discs in motion. The cam discs function in such a way that the link 67 is pulled in the direction of an arrow 104, the drive 154 in the direction of an arrow 159 and the link 58 in the direction of an arrow 105. During the motion of the links 67 and 154, the two arms of the thread-feeder 62, the holders 151, 152 and the swing-arm 83 of the cover 34 swing to the left. The cam discs function to move the link 67 back against the direction of arrow 104, to move the link 58 against the direction of the arrow 105, and to move the drive member 154 against the direction of the arrow 159. At the beginning of these backward motions, the thread cut-off devices remain closed for a limited time, i.e. as long until the rod 63 reaches the two levers 106 and 107, and only thereafter, the thread-cutting devices can be opened again.

Also, the cover 34 is opened after a time delay, and also only after the moment when the rod 63 has reached the lever 89 of the swing-arm 83. Depending on the force of the springs 80, 81 and 90, the re-positioning of the thread cutting devices and the complete opening of the cover 34 is reached only if the rod 63 is moved back by the link 67 as far as is shown in FIG. 1. The backs of the levers 106 and 107 therefore lie against the stops.

The thread which is now connected through splicing by means of pressurized air now lies in the opened thread clamping device 53, in the thread receiving slot 73 of the arm 65, in front of the opened chamber 32, in the thread receiving slot 70 of the arm 64 and in the opened thread clamping device 52.

If, subsequently, the winding station 19 resumes operation, the thread jumps out of the device 11 because of the renewed winding-tension, and the thread assumes the thread path according to the line 28 in FIG. 3. The operation of the device 11 is now finished and the device can be moved to another station. The thread is now again outside of the reach of the device 11.

The device 11 can be used as a stationary or a movable apparatus. As desired, it can be provided at each winding station and working station, respectively, of a textile machine, or sequentially used at different workstations. In another mode, the pressure reducer can receive a different setting from interval to interval, which is also made possible by the setting button 118.

The invention is not limited to the hereinafore-explained and described embodiment. For example, the thread-feeder 62 can be omitted by a small change in the construction. For this purpose, the chamber 32 must be turned so that one can look into the longitudinal groove 33 from the front because in this case the thread-feeders 42 and 46 can already place the thread into the longitudinal groove 33. The link 67 would only be required for opening and closing the cover 34, and for operating the thread-cutting devices. This simplified embodiment did at times encounter difficulties during the insertion of the threads, so that it appeared more advantageous to use a third thread-feeder 62 in conjunction with the thread-cutting devices.

The concepts "upper thread" and "lower thread" are not bound to the concepts "up" and "down". Rather, a thread is designated as a lower thread if it comes from a thread delivery point, for example, from a run-off coil or thread-producing means. The upper thread is a thread leading to a thread-receiving point, for example to a take-up coil or winding staff. Therefore, the direction in which the thread runs can be upward from below as is the case in the sample embodiment. However, the path of the thread can also be in the opposite direction, or in any other direction. For example, it can run in a horizontal path.

Besides winding machines, the device according to the invention can be used with, for example, spinning machines, frames for bobbins and similar machinery of this type.

To make it possible to securely connect threads with an unusual fiber structure and extremely thin threads, it is advantageous to insert the threads un-crossed, preferably laying parallel, into the chamber, and to keep them in this position up to the time when the compressed air is introduced. This does not exclude a crossing of the threads during the swing motion of the thread-feeders. Care must only be taken that this crossing only takes place outside of the chamber in which the splicing by compressed air is effected.

The fact that the joining of threads with unusual fiber structure is better effected with parallel-disposed threads, is explained by the fact that there the pneumatic flow conditions at the thread are more favorable, and a crossing point of the threads within the chamber is not fixed with any assurance to a pneumatically favorable spot.

The uncrossed insertion of the threads into the chamber is achieved by providing the two arms of the thread-feeder 62 with thread-receiving slots of equal depth, instead of the thread-receiving slots of unequal depth shown in the drawing.

The preceding explanations also point out the following advantages of the invention:

Even under unfavorable circumstances, the air pressure at the orifices of the compressed air channel in the chamber has relatively few fluctuations and is of sufficient strength, after the opening of the air-pressure regulating valve.

The undesirable pressure drop which occurs in long pressure lines is avoided. At the same time, there is the possibility of successfully using a pressure source with fluctuating pressure, at least in some cases. Finally, the pressure accumulator can also be made large enough so that its storage is sufficient for a number of further splicing operations, if the source of compressed air should fail.

During production change, it is not necessary to change the setting of the splicing device in all cases. However, if it should be necessary, such a change can be effected centrally, such as from a central control.

Though the illustrated brackets 151, 152 represent a good construction because they do not obstruct the air-outflow from the chamber 32, other forms of construction are possible. The brackets must not have the loop-shape shown.

The invention is obviously also applicable in cases when the splicing chamber is not provided with a cover.

There are claimed:

1. Method for connecting an upper thread to a lower thread, which comprises inserting the threads into a longitudinal groove formed in a chamber for connecting the threads with a thread feeder being movable from a thread receiving position to a thread delivery position, splicing the threads together in the chamber using compressed air acting on the threads from the side, securely holding the threads up to the application of the compressed air when the threads are inserted into the chamber uncrossed, securely holding the threads which are inserted into the chamber during the splicing in the immediate vicinity of the chamber when the threads are crossed during movement of the thread feeder, elastically pressing the threads against the outer surface of the chamber and wrapping the threads around rims of the groove formed in the chamber at an angle of approximately 90°.

2. Method according to claim 1, which includes pressing the threads with two holders.

3. Method according to claim 1, which includes pressing the threads with the thread feeder.

4. Method according to claim 1, which includes pressing the threads with separate pressing means.

5. Method according to claim 3, which includes closing the chamber with a cover, automatically severing the ends of the upper and lower threads, and blowing compressed air into the chamber, in dependence on the position of the thread feeder.

6. Method according to claim 2, which includes closing the chamber with a cover, automatically severing the ends of the upper and lower threads, and blowing compressed air into the chamber, in dependence on the position of the holders.

7. Method according to claim 1, 5 or 6, which includes locating and securing the end of each of the upper and lower thread with a hingeable thread feeder, and sequentially selectively laying the threads parallel, overlapping and crossed by swinging motion of the two hingeable thread feeders.

8. Apparatus for carrying out a method for connecting an upper thread to a lower thread, comprising a chamber for inserting and connecting the threads, a channel having an end disposed within the chamber for supplying compressed air, two holders pivotable from a starting position to a thread holding position in the immediate vicinity of said chamber, said chamber having an upper and a lower surface and a groove formed therein with discharge rims at the ends of said groove, and a flexible bracket being integral with each of said holders and respectively disposed immediately above and below said rims, said brackets being swingable above and below said surface of said chamber.

9. Apparatus according to claim 8, wherein said holders are connected to each other, and including a common drive for said holders.

10. Apparatus according to claim 8, including at least one thread feeder movable from a thread receiving position to a thread delivery position for inserting the threads into said longitudinal groove formed in said chamber, and further including a cover for temporarily closing said chamber, means for cutting off the ends of the upper and lower threads, and a regulating valve for adjustably controlling the compressed air, said cover, cutting means and valve being controllable in dependence on the position of at least one of said thread feeder and holders.

11. Apparatus according to claim 10, wherein said thread feeder is hingeably supported, and including two arms integral with said thread feeder for guiding the threads, said arms being swingable in planes lying respectively above and below said chamber.

12. Apparatus according to claim 8, including means for receiving and conducting the upper thread, a first clamping device disposed below said chamber, a second clamping device disposed above said chamber, a first pivotably supported thread feeder having means for locating and securing the end of the upper thread and being swingable from said receiving and conducting means to said first clamping device, and a second pivotably supported thread feeder having means for locating and securing the end of the lower thread and being swingable from a point in the path of the lower thread to said second clamping device.

13. Apparatus according to claim 12, including means for controlling said clamping devices in dependence on the position of one of said first-mentioned thread feeder and said pivotally supported thread feeders.

14. Apparatus according to claim 11, wherein said arms have thread receiving slots formed therein, said slots being respectively positioned obliquely above and behind and below and behind said rims in said thread delivery position of said thread feeder, whereby the threads wrap around said rims.

15. Apparatus according to claim 11 or 14, including a controllable thread cutting device disposed on each of said arms.

16. Apparatus according to claim 8, including a controllable adjustable compressed air regulating valve connected in said compressed air channel.

17. Apparatus according to claim 10, including a proximity switch for controlling said regulating valve in response to the movement of said thread feeder.

18. Apparatus according to claim 10, including means for setting and controlling air pressure being connected in said compressed air channel, and a proximity switch for controlling said air pressure setting and controlling means in response to the movement of said thread feeder.

19. Apparatus according to claim 17 or 18, wherein said proximity switch is adjustable.

20. Apparatus according to claim 16 or 17, including a settable and controllable timing switch device connected to said regulating valve.

21. Apparatus according to claim 18, including a settable and controllable timing switch device connected to said air pressure setting and controlling means.

22. Apparatus according to claim 16 or 17, including a central setting device connected to said regulating valve at a plurality of work stations.

23. Apparatus according to claim 18, including a central setting device connected to said air pressure setting and controlling means at a plurality of work stations.

24. Apparatus according to claim 21, including a central setting device connected to said timing switch device at a plurality of work stations.

25. Apparatus according to claim 16 or 17, including a compressed air accumulator connected to the air input side of said regulating valve.

* * * * *